United States Patent [19]

Battersby

[11] Patent Number: 4,611,368

[45] Date of Patent: Sep. 16, 1986

[54] DECORATIVE AND PROTECTIVE JEWELRY CHAIN GUARD

[76] Inventor: Norma Battersby, 7386 Eagle Mills Rd., Waite Hill, Ohio 44094

[21] Appl. No.: 716,813

[22] Filed: Mar. 27, 1985

[51] Int. Cl.[4] ..... F16G 15/00

[52] U.S. Cl. ..... 24/116 R; 24/116 A; 24/618; 63/2

[58] Field of Search ..... 24/116 R, 116 A, 518, 24/598, 618, 616, 617, 585, 589, 155 R; 63/4, 2

[56] References Cited

U.S. PATENT DOCUMENTS

| | | | |
|---|---|---|---|
| 229,257 | 6/1880 | King | 24/116 R |
| 326,606 | 9/1885 | Tingley | 63/4 |
| 1,092,689 | 4/1914 | Broussard | 24/155 R |
| 1,578,940 | 3/1926 | Wacha | 24/116 A |
| 1,646,999 | 10/1927 | Goodridge | 24/116 A |
| 1,794,333 | 2/1931 | Guyot | 24/618 |
| 2,259,059 | 10/1941 | Better | 24/116 R |
| 2,586,758 | 2/1952 | Zerr | 24/518 |
| 2,845,672 | 8/1958 | Molene | 24/116 A |
| 3,974,545 | 8/1976 | Lossini | 63/4 |
| 4,041,579 | 8/1977 | Chappel | 24/598 |

FOREIGN PATENT DOCUMENTS

| | | | |
|---|---|---|---|
| 958783 | 1/1957 | Fed. Rep. of Germany | 24/116 A |
| 1248047 | 10/1960 | France | 24/116 A |

*Primary Examiner*—Victor N. Sakran

*Attorney, Agent, or Firm*—Fay, Sharpe, Fagan, Minnich & McKee

[57] ABSTRACT

A decorative and protective jewelry chain guard having a first half or bottom member, a top half member, generally closed with pressure, slide, hinge or latch. One of said halves having an anchor pin firmly mounted within the guard over which the loop ends of a precious jewelry chain are fixed. The ends of a jewelry chain are placed over the anchor pin or within the chain guard itself and interconnected by a spring latch and the halves of the chain guard are closed around the chain ends.

Various decorative treatments can be made to the chain guard for ornamental appearances, but in essence, it is a protective jewelry chain guard used to prevent loss or accidental breakage of the chain and its ends so that there will be less chance of loss to the wearer.

11 Claims, 17 Drawing Figures

FIG. 1
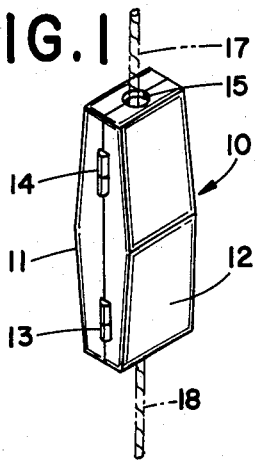
FIG. 2
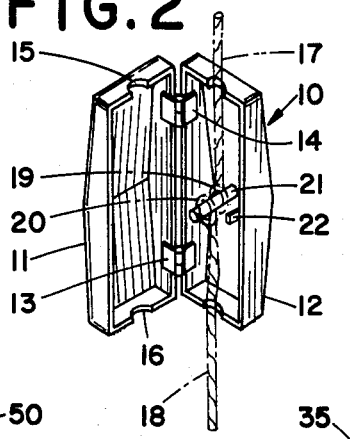
FIG. 3
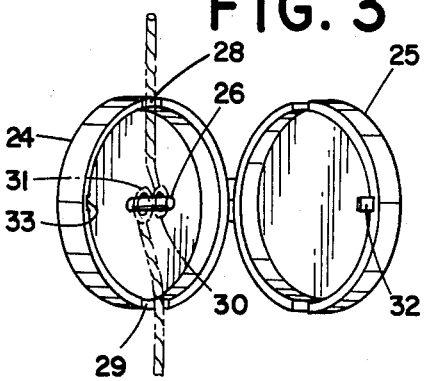
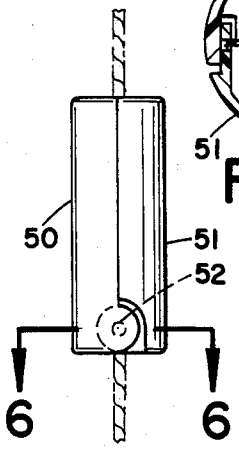
FIG. 4
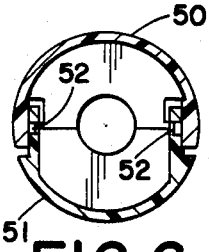
FIG. 6
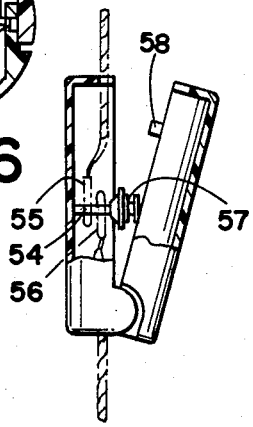
FIG. 5
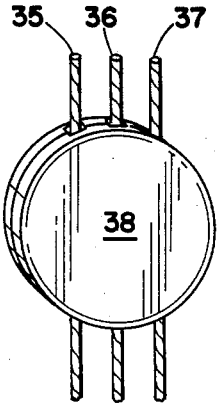
FIG. 7
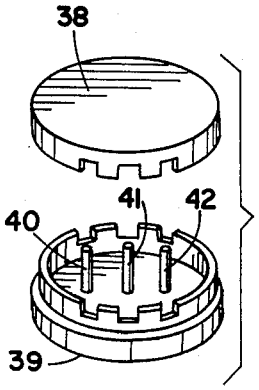
FIG. 8
FIG. 9
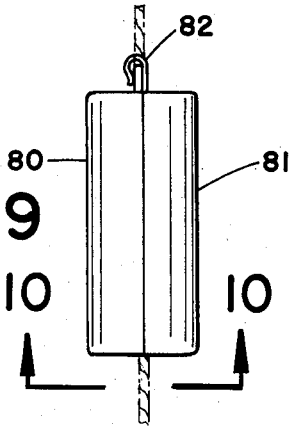
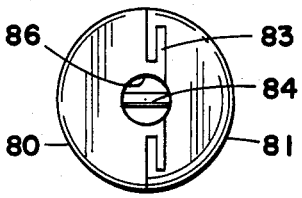
FIG. 10
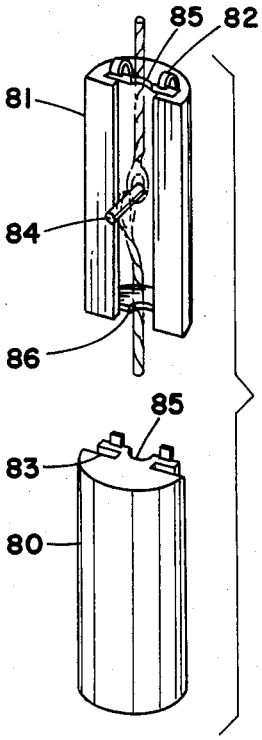
FIG. 11

DECORATIVE AND PROTECTIVE JEWELRY CHAIN GUARD

BACKGROUND OF THE INVENTION

The wearers of jewelry have been confronted with loss of their jewelry because of accidental breakage or displacement of the end clips. These are generally gold or silver, and sometimes jeweled chains, which have an end that consists of a loop which is usually rotary mounted. Two ends of the chain, which are larger than the chain itself, are interconnected therein.

There has been little done in the past to prevent loss of the chain. The invention is a protective jewelry chain adapted to mount over and around the ends of a jewelry chain and its loops to prevent the accidental displacement of the ends of the chain guard.

SUMMARY OF THE INVENTION

This invention relates to a decorative, but protective chain guard for precious chains, generally gold or silver, and sometimes jeweled, so that the wearer will not feel that they will break or become displaced by movement of the wearer or by brushing against some object. Occasionally there is a theft problem which this chain guard would prevent.

The object of the invention is to put a pair of halves, to form a protective covering or enclosure that fits over the closed (fastened) chain or end loops and may or may not have an anchor pin over which the loop end of the chain may be placed for additional protection. In each of the halves would be an aperture or opening through which the chain would pass. If the chain were a link chain, the aperture would be tightly fitting around one of the links.

BRIEF DESCRIPTION OF THE DRAWINGS

FIG. 1 is a perspective view of the jewelry chain guard;

FIG. 2 is a perspective view opened of the chain guard of FIG. 1;

FIG. 3 is a view in open position of another chain guard;

FIG. 4 is front view of another chain guard;

FIG. 5 is partial cross sectioned view of FIG. 4 of the guard in open position;

FIG. 6 is an enlarged cross sectional view of FIG. 4 along the lines 6—6;

FIG. 7 is perspective view of a modified chain guard;

FIG. 8 is an exploded view of FIG. 7 showing the multiple chain guard in open position;

FIG. 9 is a front view of a modified chain guard;

FIG. 10 is an enlarged bottom view along the lines 10—10 of FIG. 9;

FIG. 11 is an exploded view of the guard of FIGS. 9 and 10;

DESCRIPTION OF THE PREFERRED EMBODIMENT

The object of this invention is to provide the wearer with a chain guard that can protect a valuable chain so that it will not become separated from the wearer.

The principle purpose of the chain guard is to provide a combination of an anchor pin and closure halves to protect the ends of the chain so that they will not become separated and thus the wearer can feel confident that, unless there is some unusual occurrence, the chain will stay in place on the neck.

In operation, a wearer places one end of the chain around the anchor pin. In the event that there is no anchor pin, the ends of the chains can be joined and the large size of the ends will prevent their being pulled through the apertures of the chain guard. Ornamentation and/or jewels may be placed on either or both faces of the chain guard. When this operation if complete, the halves of the chain guard are closed by means of a latch and the wearer is protected from most accidental incidences that may occur.

With this invention, there are illustrated a number of embodiments of chain guards:

FIG. 1 shows chain guard generally at 10, the first half member at 11 and a top member at 12. They are pivoted with a hinge means as seen at 13 and 14 and are of various external shapes, as will be seen from the figures that follow. At one end is an aperture 15 and 16 at the other end. The chain itself is shown at 17 the other end is shown at 18. Each of the chain ends has a loop as shown at 19 and 20. They are mounted around an anchor pin 21. A clasp holds the chain guard together as seen at 22.

FIG. 3 shows an open view of a round chain guard. The top half is shown at 24, the bottom half at 25. There is an anchor pin at 26 and an opening for the chain as seen at 28 and in the lower portion at 29. The loops of the chain are seen at 30 and 31. The clasp is shown at 32, and the receiver is shown at 33.

FIGS. 7 and 8 show a comparable chain guard for a multi-strand chain 35, 36, and 37 and the top half is shown at 38 and the bottom half at 39. There are of course comparable openings in the halves so that the chains may pass through. In this instance, there are three anchor pins one is shown at 40, 41, and 42.

FIGS. 4, 5 and 6 show another version of the chain guard in which a top half is shown at 50 and a bottom half at 51 and a pivoted hinge at 52. FIG. 6 shows an enlarged cross section through the pivot joint and the clasp is shown at 53 in FIG. 5. The anchor pin is seen at 54 and the chain ends are seen at 55 for the upper end and 56 for the lower end. A bayonet type keeper is shown at 57 which may be mounted on the anchor pin and held in place so that there is no accidental displacement of the chain ends, should the chain guard accidentally open. This keeper can be used on most of the chain guards shown in this invention.

Figure 12:
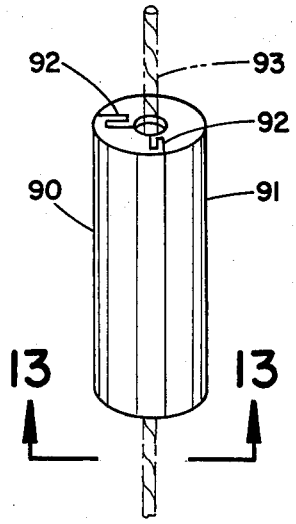
FIG. 12 is a further variation of the guard of FIGS. 9–11 shown in perspective.
Figure 13:
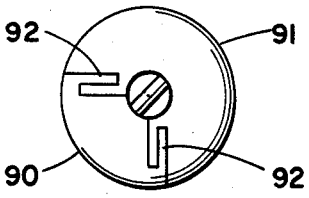
FIG. 13 is an enlarged bottom view of FIG. 12 along the lines 13–13.
Figure 14:
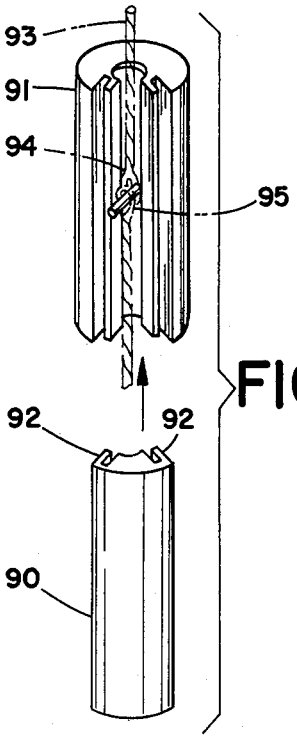
FIG. 14 is an exploded view of FIGS. 12 and 13 in opened position.
Figure 15:
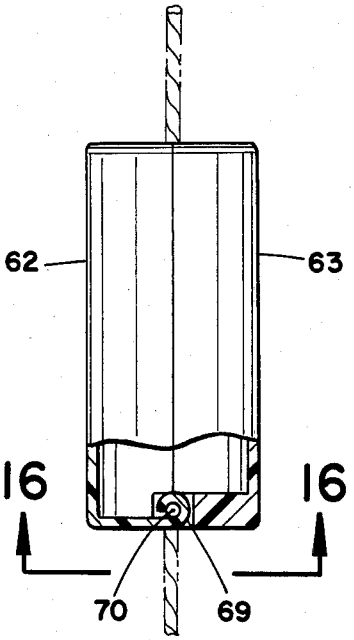
FIG. 15 is a partial cross sectional view of a further variation of the chain guard.

FIGS. 9, 10 and 11 show another form of chain guard and FIGS. 12, 13 and 15 show still another version. In FIGS. 9, 10 and 11 we have complementary halves of a cylindrical chain guard in which the chain guards slide together to latch. In FIGS. 12, 13 and 14 we have complementary portions in which the segments interfit to form a complete circle but are complementary to fill out the circle. In FIG. 9 we have a top half at 80, a bottom half at 81, a loop catch at 82. From the bottom we have a dovetail connection as seen at 83, anchor pin as seen at 84 and there is an aperture, of course, at each end as seen at 85 at the top, and 86 at the bottom, to permit the chain to pass through. In practice the chain ends would be placed over the anchor pin 84 and the top half 80 would be slid through its dove tailed connection 83 to secure the chain guard around the necklace or chain. The aperture 85 is smaller the loop catch 82 and fits tightly around the chain.

FIG. 12 shows a similar chain guard in which the left portion of the chain guard is seen at 90, the right portion at 91, the dovetail connection is seen at 92. In this instance it is a 270° segment and a 90° segment. FIG. 14 shows the exploded view in which the 270° segment is seen and encompasses the chain at 93 which has its loop 94 and 95. The segment 90 slides up around and into the grooves of the dovetail to a latch which is not shown complementing the full circle and protecting the anchor pin and chain ends.

Figure 16:
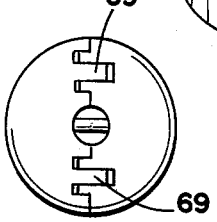
FIG. 16 is a bottom view of the guard of FIG. 15 along the lines 16—16 of FIG. 15.
Figure 17:
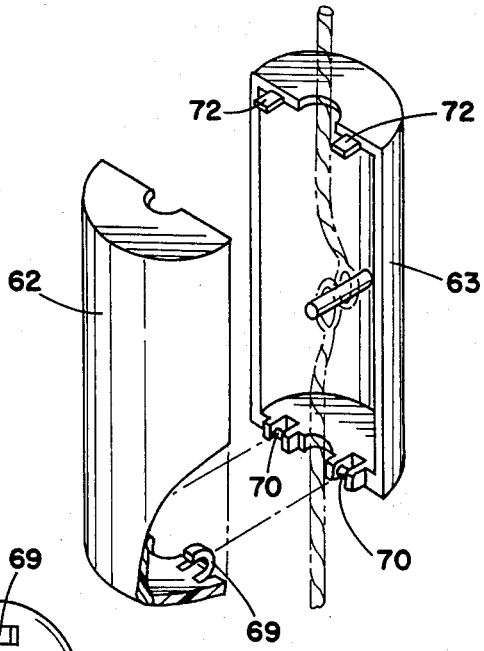
FIG. 17 is an exploded view of FIGS. 15 and 16 showing the clasps for the guard.

FIGS. 15, 16 and 17 show a further version in which a top half is shown at 62 and a bottom half at 63, in the top half is a loop or hook member, 69 which fits around a pair of pins 70 in the bottom half. As a result the top half is placed in position and hooked to the bottom half and a latch as shown at 72 holds the chain guard in position.

Thus having described the basic form of the chain guard and its various varieties, I do not wish to be limited by the foregoing disclosure but rather by the claims which follow.

What is claimed is:

1. A protective guard for the ends of a chain of jewelry or the like comprising:

a first shell member;

a second shell member which is adapted to mate with said first shell member to form a casing having a cavity therein, the ends of an associated chain of jewelry being positionable in said casing;

a pair of apertures, one formed at each end of said casing, said apertures being sized so that at least sections of said chain can extend therethrough;

an anchor pin secured to one of said shell members and projecting from the middle thereof into said cavity, said pin being suitably sized so that both end links of said associated chain member can be looped over said pin; and, a connection means for selectively securing said first and second shell members to each other in a closed position, said connection means enabling said shell members to be selectively moved relative to each other to an open position to provide access to said end links of said associated chain member.

2. The guard of claim 1 further comprising keeper means for holding said end links of said associated chain member in position on said anchor pin.

3. The guard of claim 2 wherein said keeper means comprises:

a keeper body adapted to be pushed onto a free end of said anchor pin;

an aperture extending into said keeper body for receipt of said anchor pin; and, securing means for selectively holding said keeper body on said anchor pin, said securing means being positioned adjacent said aperture so as to be able to contact said anchor pin.

4. The guard of claim 1 further comprising latch means for securing said first and second shell members to each other.

5. The guard of claim 4 wherein said connection means comprises a hinge means for enabling said first and second shell members to rotate with respect to each other between an open position and a closed position.

6. The guard of claim 5 wherein said latch means are positioned on the opposite side of said first and second shell members from said hinge means.

7. The guard of claim 1 wherein said connection means comprises interconnecting sliding sections provided on said first and second shell members.

8. The guard of claim 1 wherein a plurality of anchor pins project into said cavity so that the end links of each of a plurality of associated chain members can be looped over a respective one of said plurality of pins.

9. A readily openable guard device protecting the adjacent ends of a jewelry chain, comprising:

a first shell member;

a second shell member which is adapted to mate with said first shell member to form a casing having a cavity therein, said casing being adapted to hold the ends of an associated chain of jewelry;

a pair of apertures formed at opposing ends of said casing, said apertures being sized so that sections of said associated chain adjacent the ends thereof can extend therethrough, but so as to prevent the end loops of said chain from pulling through said apertures;

hinge means secured on said casing for hingedly connecting said first and second shell members to each other and for enabling said shell members to be selectively pivoted toward and away from each other;

an anchor pin centrally secured to one of said shell members and projecting into said cavity, wherein said end loops of said associated chain member can be looped over said pin; and, a keeper means secured to said anchor pin and adapted to prevent said end loops of said associated chain from being pulled off said anchor pin.

10. The guard of claim 9 further comprising a latch for securing said first and second shell members to each other in said casing.

11. The guard of claim 10 wherein a plurality of anchor pins are secured to said shell members and project into said cavity so that the end links of each of a plurality of associated chain members can be looped over a respective one of said plurality of pins.

* * * * *